US006390194B1

(12) United States Patent
Young et al.

(10) Patent No.: US 6,390,194 B1
(45) Date of Patent: May 21, 2002

(54) METHOD AND APPARATUS FOR MULTI-DIAMETER TESTING OF BLOWOUT PREVENTER ASSEMBLIES

(76) Inventors: Joe Alfred Young, 163 Triple J. Rd., Monterey, LA (US) 71354; James Lee Young, 1745 E. Willow St., Lafayette, LA (US) 70501

( * ) Notice: Subject to any disclaimer, the term of this patent is extended or adjusted under 35 U.S.C. 154(b) by 0 days.

(21) Appl. No.: 09/724,374

(22) Filed: Nov. 27, 2000

Related U.S. Application Data

(63) Continuation of application No. 09/088,735, filed on Jun. 2, 1998, now Pat. No. 6,152,225.

(51) Int. Cl.[7] ..... E21B 47/10

(52) U.S. Cl. ..... 166/250.08; 73/152.54; 166/337

(58) Field of Search ..... 166/250.08, 336, 166/337, 113; 73/45.5 R, 46, 152.54

(56) References Cited

U.S. PATENT DOCUMENTS 4,018,276 A * 4/1977 Bode ..... 166/250.08
4,030,345 A * 6/1977 Scott ..... 166/250.08 X
4,090,395 A * 5/1978 Dixon et al. ..... 166/250.08 X
4,306,447 A * 12/1981 Franks, Jr. ..... 73/40.5 R
4,669,537 A * 6/1987 Rumbaugh ..... 166/113
4,881,598 A * 11/1989 Stockinger et al. .... 166/250.08
6,044,690 A * 4/2000 Williams ..... 166/250.08 X
6,152,225 A * 11/2000 Young et al. ..... 166/250.08

* cited by examiner

*Primary Examiner*—George Suchfield
(74) *Attorney, Agent, or Firm*—Ted M. Anthony

(57) ABSTRACT

A method and apparatus for testing blowout preventer systems that enables testing of various size pipe rams, as well as safe and efficient shut-in of a well, without having to trip the entire apparatus out of a well. The testing apparatus generally includes an upper elongated testing cylinder, an upper test seal assembly, a lower elongated testing cylinder, a lower test seal assembly and a test plug. Additionally, the testing apparatus may include a circulating flow assembly, a side-port assembly, and a check-valve assembly, all of which are axially connected in a series to allow the testing tool to be easily lowered into a riser to a subsea blowout preventer assembly. The subject invention permits testing of blowout preventers that are designed to seal around various size pipe diameters during a single pipe trip. The invention also allows the operator to efficiently and safely shut-in a well if a kick is experienced during testing operations.

4 Claims, 4 Drawing Sheets

METHOD AND APPARATUS FOR MULTI-DIAMETER TESTING OF BLOWOUT PREVENTER ASSEMBLIES

This is a continuation of application Ser. No. 09/088,735, filed Jun. 2, 1998, now U.S. Pat. No. 6,152,225.

BACKGROUND—FIELD OF THE INVENTION

The subject invention relates generally to a method and apparatus for testing the pressure integrity of blowout preventer systems which are used to control the flow of high pressure fluids from a well. More particularly, the subject relates to a blowout preventer test tool that enables a tool operator to test the pressure integrity of various size blowout preventers without removing the test tool from a well between tests. More particularly still, the subject invention relates to a blowout preventer test tool that enables a tool operator to test the pressure integrity of variable bore rams against different size pipe without removing the test tool from a well between tests. More particularly still, the subject invention relates to a blowout preventer test tool which allows a well to be safely and efficiently shut in should a "kick" be experienced during testing operations.

BACKGROUND—DESCRIPTION OF RELATED FIELD

During the drilling of oil and gas wells, the hazard of a sudden and violent expulsion of fluids, often referred to as a "blowout," is always present where wells are drilled into porous and permeable rocks containing pressurized gas, oil, and water. Blowouts are extremely dangerous to human life, and can cause extensive damage to property. Furthermore, blowouts waste time, money, and formation pressure needed to commercially raise oil and gas from an underground reservoir to the surface.

During the drilling process, the primary mechanism for preventing a well from "blowing out" is the hydrostatic pressure imparted on the exposed formation(s) in the well by a column of fluid, typically drilling mud, contained within the well bore. Ideally, this hydrostatic pressure should be roughly equivalent to the pore pressure of said formation(s), resulting in a balanced system. In the event that such hydrostatic pressure is insufficient, the high pressure gas and liquids contained within said formation(s) can invade the well bore and displace drilling fluid from the well. This phenomenon is commonly known as a "kick." If prompt corrective action is not taken at the first indication of a kick, control of the well can be lost and a blowout can occur.

Blowout prevention systems have been developed to protect against the uncontrolled flow of fluids from a well. Blowout prevention systems provide a means of shutting in a well at or near the surface of the well in order to gain control of a kick before it becomes a blowout. A typical blowout preventer system or "stack" typically consists of a number of individual blowout preventers, each designed to seal the well bore and withstand pressure from the formation.

Drilling operations conducted from moveable drilling rigs such as drill ships, semi-submersible rigs and certain jack-up rigs differ from operations conducted from platform-supported drilling rigs in many respects. Among these differences is the location of the blowout preventer and wellhead assemblies. When drilling from drill ships, semi-submersible rigs and certain jack-up rigs, the blowout preventer and wellhead assemblies are not located on the drilling rig, but rather on the sea floor; as a result, specialized equipment known as "subsea" blowout preventers and wellheads are utilized. A large diameter, flexible pipe known as a riser is used to connect the subsea assemblies to the offshore rig. During drilling operations, drill pipe and other downhole equipment is lowered from the rig through the riser, as well as through the subsea blowout preventer assembly and wellhead, and into the hole which is being drilled.

Although there are numerous different types of blowout preventers, one very common variety is the ram-type blowout preventer. Ram preventers utilize sets of large, opposing piston-like elements (rams) which can be selectively closed to seal off a well bore. Pipe rams can be used to seal a well when drill pipe is in use by closing around the pipe and sealing off the annulus formed between the outer surface of the drill pipe and the inner surface of the well. Blind rams can be used to completely seal off a well bore when no pipe is in use. In very extreme cases, shear rams can also be used to completely cut through drill pipe in the well and seal off the well.

Because pipe rams form a seal around the outer surface of drill pipe, the rams must generally be designed to close around a particular size of drill pipe. For example, pipe rams which are designed to be used with 5-inch outer diameter drill pipe are specifically designed to accommodate only that size pipe; such rams will generally not form a seal around pipe having a larger or smaller outer diameter. Additionally, specialized rams known as variable bore rams exist which can be used to form a seal around different size drill pipe within a given range of pipe diameters.

Although certain wells can be drilled using a single size drill pipe, it is very common to use a tapered drill string in the drilling process. The term "tapered drill string" refers to a drill string which consists of larger diameter drill pipe in one portion of a well, and smaller diameter drill pipe in another portion of said well. By way of example, a typical tapered drill string might involve the simultaneous use of both 5-inch outside diameter drill pipe, as well as 3½-inch outside diameter drill pipe in the same well. As such, a blowout preventer system utilized in connection with such a tapered drill string must be capable of sealing off the annular space around both the larger and the smaller drill pipe size.

Because blowout preventer systems are generally considered emergency equipment, active blowout preventer systems must be frequently checked and pressure-tested to ensure that they remain in good working condition. In many instances, governmental regulations require frequent testing of blowout preventer equipment. In order to accomplish such testing on subsea blowout preventer assemblies, a tubular test tool is typically coupled to a drill pipe string or other work string and lowered from the drilling rig to the blowout preventer assembly which is located on the sea floor. First, a test plug at the base of the test tool is seated within a well head assembly which is located immediately below the blowout preventer assembly. Thereafter, a selected blowout preventer is individually closed to form a seal around the outer surface of the tubular test tool, thereby creating an enclosed zone between the test plug and the closed blowout preventer. High pressure fluid is thereafter introduced into the enclosed zone created between the test plug and the blowout preventer in order to test the pressure integrity of said blowout preventer. This process is then repeated to test the other blowout preventers of the blowout preventer assembly. After all blowout preventers of a particular size have been tested, the entire test tool must generally be pulled out of the well, and a different size test tool must be run into the well before another size blowout preventer can be tested in the same manner.

It is important to note that in a subsea application, blowout preventers can be located several thousand feet below a drilling rig. For this reason, tripping a test tool in and out of a well via drill pipe often requires a significant amount of time to accomplish. Because drilling rigs are typically contracted on the basis of a "daily rate", the more time required to perform operations, including blowout preventer testing operations, the more expensive a particular drilling project becomes. As such, there is a need to conduct blowout preventer tests in an efficient manner, and to minimize the number of pipe trips required to conduct such test blowout preventers.

Several inventions have been directed toward providing a test tool for blowout preventer assemblies. U.S. Pat. No. 4,090,395 to Dixon et al. discloses an apparatus which can be used for testing both blowout preventers and wellhead casing hanger seals. The apparatus disclosed in Dixon includes a tubular member which is equipped with a means for sealing off a casing hanger opening. To operate the test tool disclosed in Dixon, a tubular member is lowered into and through a wellhead so that sealing means can be employed to seal off a casing hanger. A blowout preventer is closed to create an annular chamber between the blowout preventer to be tested and the casing hanger. The pressure integrity of the blowout preventer can then be tested by introducing high pressure fluid into this annular chamber. The apparatus disclosed in Dixon is limited to testing against single size diameter pipe strings, and does not provide a means for safely and efficiently controlling the well should a kick be experienced during the testing procedure.

U.S. Pat. No. 4,018,276 to Bode discloses a blowout preventer test plug which comprises two cylindrical bodies positioned on a tubular extension, with each cylindrical body having fluid passage ports therethrough. When the two cylindrical bodies are moved into contact, said fluid passage ports are closed and a seal is created between the tubular extension and the inner diameter of the wellhead bore. The blowout preventer tool disclosed in Bode cannot be used to test against various size pipe strings, nor does it allow an operator to safely and efficiently shut in the well, if necessary.

U.S. Pat. No. 4,881,598 to Stockinger, et al, discloses a subsea blowout preventer test apparatus which permits testing of two different size blowout preventers on a single pipe trip. The test apparatus disclosed in Stockinger includes an inner elongated cylindrical testing mandrel which is telescopingly received within a larger outer elongated cylindrical testing mandrel. A releasable locking means is provided for releasably locking the testing mandrels in a telescopingly extended position so that the blowout preventer system can first be tested against the inner testing mandrel. Thereafter, said testing mandrels can be shifted into a telescopingly collapsed position such that the blowout preventer system can also be tested against the larger diameter outer testing mandrel. Although the testing apparatus disclosed in Stockinger may permit the testing of two different size blowout preventers in a single pipe trip, it does not permit such testing on two cylindrical mandrels having similar or very close outer diameters. By way of example, the apparatus described in Stockinger cannot accommodate the testing of blowout preventers against both 5" outer diameter drill pipe and 5½" outer drill pipe in a single pipe trip, since the smaller cylindrical mandrel cannot be telescopingly received within the larger cylindrical mandrel. Moreover, in instances where the wall thickness of the outer testing mandrel must be reduced in order to permit the inner testing mandrel to be telescopingly received therein, the trength of the tool can also be greatly reduced resulting in a much greater risk that the tool could be pulled apart in the well. Further, the apparatus disclosed in Stockinger will permit testing of a maximum of two different size blowout preventers in a single pipe trip, and does not provide a means for safely and efficiently controlling a well when a kick is experienced during testing operations.

In summary, the prior art fails to disclose a method of testing or apparatus that can be used to test the pressure integrity of various size blowout preventers (including blowout preventers equipped with variable bore rams) against pipe having different yet very similar outer diameter dimensions, without making multiple trips in and out of a well, but which can also permit safe and efficient control of a well should a kick be experienced during testing operations. As illustrated more fully below, the present invention saves time and expense by providing a blowout preventer test tool that can permit the testing of multiple size blowout preventers in a single pipe trip, while also providing a means to safely and quickly shut in a well when necessary. Moreover, unlike telescoping blowout preventer test tools, the apparatus of the present invention permits the testing of blowout preventers against a number of pipes having different, yet very similar, outer diameter dimensions. Further, the present invention can withstand greater pulling forces than existing telescoping test tools, since there is no need to reduce the wall thickness of its various components.

SUMMARY OF THE INVENTION

The present invention relates to a method and apparatus for testing subsea blowout preventer assemblies that enables an operator to test various size blowout preventers, as well as variable bore rams, against pipe having different outer diameter dimensions on a single pipe trip. Furthermore, the apparatus of the present invention allows an operator to quickly and safely shut-in a well in the event that a kick is experienced during testing operations. The testing apparatus of the present invention generally comprises a plurality of elongated testing cylinders connected to a plurality of test seal assemblies, all of which are slidably received within a test plug having a bore therethrough. In its preferred embodiment, the testing apparatus of the present invention generally comprises the following elements: a plurality of elongated testing cylinders, each having a different outer diameter dimension; a plurity of test seal assemblies connected to said elongated testing cylinders and spaced between said elongated testing cylinders in alternating fashion; and a test plug having a bore therethrough which is slidably disposed on said elongated testing cylinders and test seal assemblies. Additionally, the testing apparatus of the present invention can also be equipped with a circulating test assembly to permit testing of pressure integrity of choke lines, kill lines and associated valves, as well as a side-port assembly, and a check-valve assembly.

The testing apparatus of the present invention is used to test the pressure integrity of a subsea blowout preventer assembly by lowering said testing apparatus into a well on drill pipe or other tubular work string. Although not absolutely required, it is generally preferable to attach an additional amount of work string, typically several hundred feet, to the bottom of the testing apparatus. The testing apparatus is then run into the well until the test plug is landed in a wellhead assembly which is situated immediately below a blowout preventer assembly to be tested. When properly landed within said wellhead assembly, the test plug forms a pressure-tight seal which seals off the wellbore. While it is envisioned that said test plug may seal directly against said wellhead, it is possible that the test plug may seal against a wear bushing or other apparatus within the wellhead. The lowermost test seal assembly is slidably disposed within the inner bore of the test plug; however, said lowermost test seal assembly is releasably locked in a stationary position within said test plug inner bore by a connector means when the testing apparatus is run into the well. When the test plug is landed within said wellhead assembly, the lowermost elongated testing cylinder is positioned in direct alignment with the blowout preventer assembly to be tested. In this position, individual blowout preventers are selectively closed against the outer circumference of said lowermost elongated testing cylinder, thereby defining an enclosed test zone between the test plug and the closed blowout preventer to be tested. Pressurized fluid is then introduced into said enclosed test zone utilizing the blowout preventer assembly choke or kill lines. In the event that the blowout preventer being tested fails to withstand the test pressure, then a satisfactory test will not be obtained and fluid flow will be observed at the surface from the well annulus. Alternatively, in the event that the blowout preventer withstands the test pressure but the test plug leaks, then fluid will pass around said test plug and enter the tubular work string situated below said testing apparatus. Under this scenario, a satisfactory test will not be obtained, and fluid flow will be observed at the surface from the work string.

After all desired testing under the aforementioned configuration (i.e., against said lowermost elongated testing cylinder) is complete, the lowermost test seal assembly can be releasably disconnected from the test plug. Once disconnected, transfer of weight to the testing apparatus via the tubular work string will permit downward movement of the lowermost test seal assembly and lowermost elongated test cylinder through the inner bore of the test plug. The testing apparatus can be shifted in this manner until a desired upper test seal assembly is concentrically positioned within the inner bore of the test plug, and a desired upper elongated testing cylinder having a different outer diameter than other elongated test cylinders of the testing apparatus is positioned in direct alignment with the blowout preventer assembly. Once the testing apparatus is shifted in this manner, additional components of the blowout preventer assembly can be closed against the outer circumference of said upper elongated testing cylinder, thereby defining an enclosed test zone between the test plug and the closed blowout preventer component being tested. Pressurized fluid can then be introduced into said enclosed test zone in order to test the pressure integrity of said blowout preventer component. After this testing is completed, the test tool can again be shifted, and the entire process can be repeated as desired for each elongated testing cylinder. The uppermost test seal assembly is prevented from passing through the inner bore of the test plug by a "no-go" shoulder located near the top of the uppermost test seal assembly. Additionally, the uppermost test seal assembly may also include a connector means to lock said uppermost test seal assembly in a stationary position within the inner bore of said test plug in a final shifted position. Thus, after all testing is completed, the work string can be pulled out of the well, and the entire test tool can be completely retrieved from the well bore.

Should a kick be experienced during testing operations, the entire test apparatus can be picked up via the work string and lifted to a position above the blowout preventer assembly. The well can then be shut in by closing one or more blowout preventers around tubular work string connected to the bottom of the testing apparatus. Necessary corrective action can then be taken to kill the well and restore said well to a controlled condition, including pumping through the work string.

It is an object of the present invention to provide a method for testing blowout preventer assemblies which permits the testing of multiple size blowout preventers in a single trip.

It is an object of the present invention to provide a blowout preventer test tool that permits testing of multiple size blowout preventers in a single pipe trip.

It is another object of the present invention to provide a blowout preventer test tool that permits testing of multiple size blowout preventers, as well as variable bore ram blowout preventers, against pipe having different outer diameter dimensions in a single pipe trip.

It is yet another object of the present invention to provide a blowout preventer test tool that permits testing of multiple size blowout preventers, as well as variable bore ram blowout preventers, against pipe having different yet very similar outer diameter dimensions in a single pipe trip.

It is another object of the present invention to provide a blowout preventer test tool that permits a well to be quickly and safely shut in should a kick be experienced during testing operations.

Other aspects, advantages and objects of the invention will become apparent to those skilled in the art upon reviewing the following detailed description, the drawings and appended claims.

DESCRIPTION OF THE PREFERRED EMBODIMENT

While the present invention will be described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the present invention not be limited to the particular embodiments disclosed as the best mode contemplated for carrying out this invention, but that the invention will include all embodiments (and legal equivalents thereof) falling within the scope of the appended claims.

Figure 1:
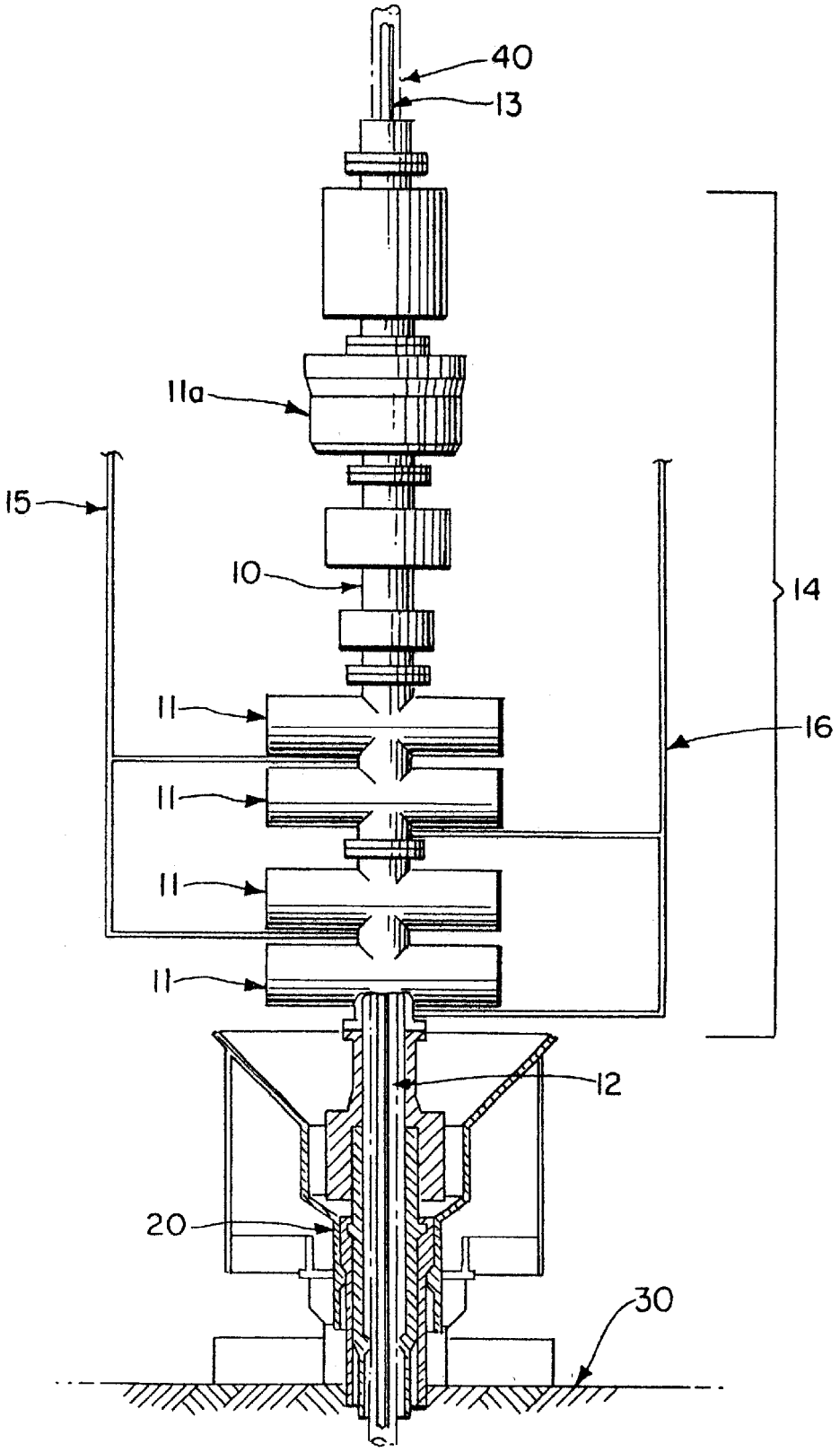
FIG. 1 is a schematic elevation view of a typical subsea well having a blowout preventer assembly mounted on top of a well head which is located on the ocean floor.

Now referring to FIG. 1, a typical blowout preventer assembly 10 is connected to a wellhead 20, which, in the case of a subsea well, is located on the ocean floor 30. Riser 40 connects blowout preventer system 10 to a drilling vessel (not shown) located at the surface of the body of water.

A typical blowout preventer assembly 10 includes a plurality of individual blowout preventers 11 and 11*a*, which are devices that allow a well to be sealed to confine well fluids within well bore 12. Two types of blowout preventers are commonly used: ram preventers 11 and annular preventers 11*a*. Ram blowout preventers utilize hydraulically actuated rams which work in opposing pairs to close the annular space around pipe 13 in well bore 12. In order to properly function and seal a well, pipe rams must fit around whatever kind or size of pipe that is in well bore 12. Annular blowout preventers 11*a* can seal around any object in well bore 12, or upon themselves, and are usually mounted at or near the top of blowout preventer system 10. A typical blowout preventer assembly 10 will extend to a height 14 above wellhead 20 in the range of 32 to 35 feet.

Choke lines 15 and kill lines 16 extend from the drilling vessel to blowout preventer assembly 10 to enable circulation of fluids to and from blowout preventer assembly 10 from the surface. Choke lines 15 and kill lines 16 can be used to pump fluids to and from blowout preventer assembly 10 even when blowout preventers 11 and 11*a* are closed.

As a well is being drilled, it is common to utilize a larger diameter drill pipe during the early stages of the drilling process, and thereafter to use a smaller diameter drill pipe during the later stages of the drilling process. Moreover, it is also common to utilize a tapered drill string, wherein drill pipe having different outer diameters is used in the well simultaneously. As such, blowout preventer assembly 10 must be designed to safely and effectively close and seal against both larger and smaller size drill pipe. This is typically done by configuring blowout preventer assembly 10 with multiple ram-type blowout preventers 11 equipped with different size pipe rams. Further, it is also common to configure blowout preventer assembly 10 with at least one blowout preventer equipped with variable bore rams, which can form a seal around different size pipe within a given range of pipe diameters.

Figure 2:
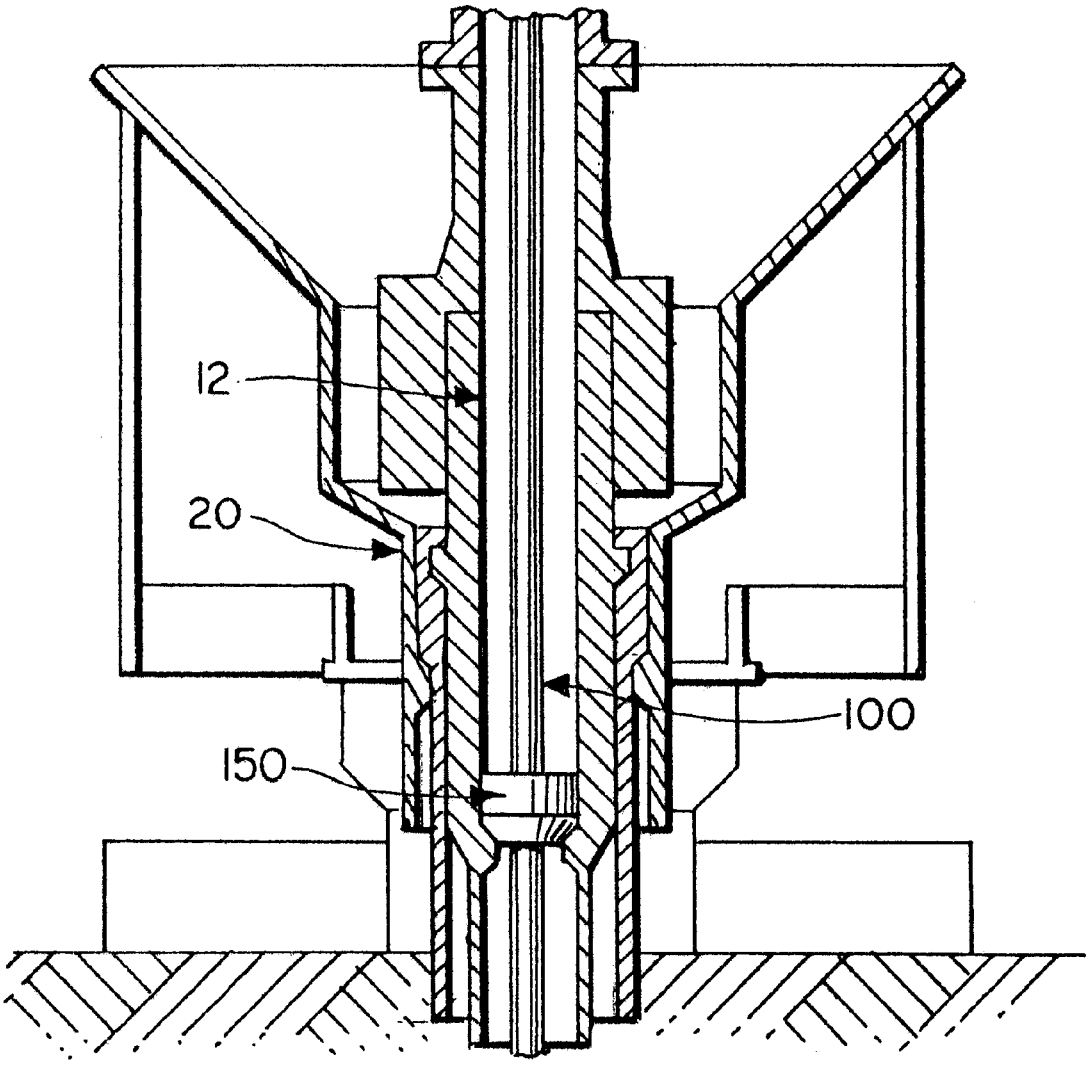
FIG. 2 is a schematic elevation and partial cut away view of the testing apparatus of the present invention installed in a subsea well.

Referring to FIG. 2, blowout preventer test tool 100 is depicted as being installed in wellhead 20 and well bore 12. Test plug 150 is seated within well head 20, creating a pressure-tight seal between test plug 150 and the inner surface of well head 20.

Figure 3:
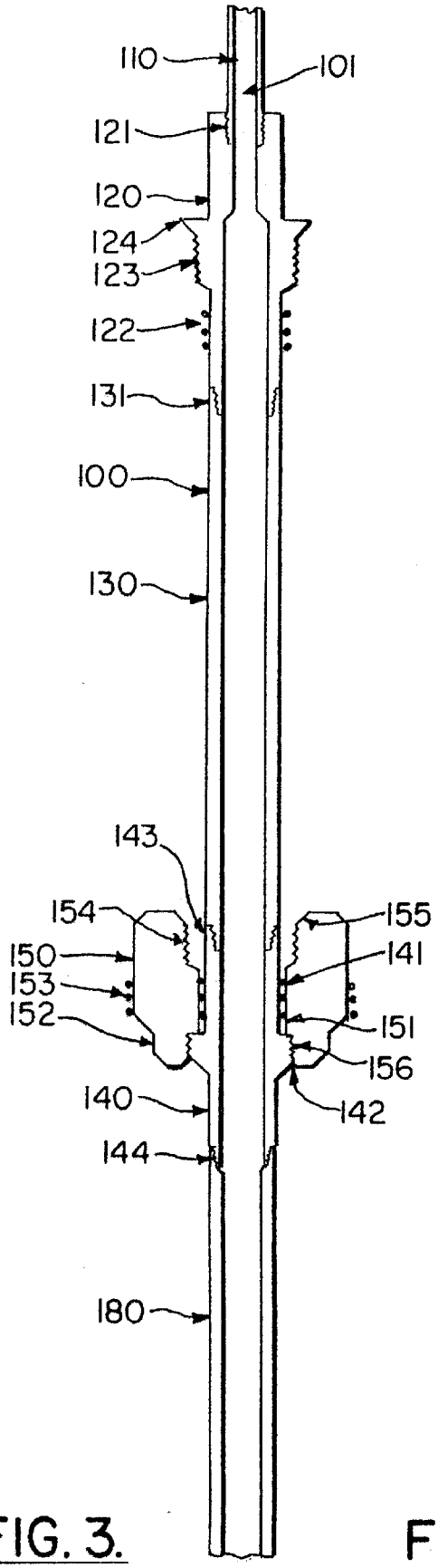
FIGS. 3 and 3*a* are schematic elevation views of the preferred embodiment of the testing apparatus of the present invention.

Referring to FIG. 3, the preferred embodiment of blowout preventer test tool 100 generally comprises upper elongated testing cylinder 110, upper test seal assembly 120, lower elongated testing cylinder 130, lower test seal assembly 140, and test plug 150. Test plug 150 has inner bore 151, and is slidably disposed on test tool 100. It may be envisioned that blowout preventer test tool 100 of the present invention may be equipped with any number of elongated testing cylinders and test seal assemblies to facilitate testing of blowout preventers against many different sizes of pipe. Thus, although the preferred embodiment contains two elongated testing cylinders and two test seal assemblies, it is by no means a limitation of the present invention.

It may further be envisioned that upper elongated testing cylinder 110, upper test seal assembly 120, lower elongated testing cylinder 130 and lower test seal assembly 140 may be constructed from a single tubular member. However, in the preferred embodiment, each of the aforementioned components constitute separate elements which are joined together, preferably by standard threaded connections. Accordingly, in the preferred embodiment, the bottom of said upper elongated testing cylinder 110, upper test seal assembly 120, lower elongated testing cylinder 130 and lower test seal assembly 140 are each equipped with a connector, which is preferably a threaded pin connector, while the top of each such component is likewise equipped with a connector, which is preferably a threaded box connector.

Upper elongated testing cylinder 110 has inner bore 101 extending therethrough. Although not required, upper elongated testing cylinder 110 may be a length of standard drill pipe or other tubular work string having a desired outer diameter dimension.

Upper test seal assembly 120 is generally cylindrical in shape with inner bore 101 extending therethrough. The top of upper test seal assembly 120 is attached to the bottom of upper elongated testing cylinder 110 by means of threaded connection 121. Circumferential seals 122 are disposed around outer diameter of upper test seal assembly 120. Upper test seal assembly 120 also has coarse right-hand male threads 123, and no-go shoulder 124.

Lower elongated testing cylinder 130 has inner bore 101 extending therethrough, and is connected at its top to the bottom of upper test seal assembly 120 by means of threaded connection 131. In the preferred embodiment, lower elongated testing cylinder 130 has a length of approximately forty (40) feet. Although not required, lower elongated testing cylinder 130 may be a length of standard drill pipe or other tubular work string having a desired outer diameter dimension.

Lower test seal assembly 140 is generally cylindrical in shape, and inner bore 101 extends through said lower test seal assembly. Lower test seal assembly 140 is connected at its top to the bottom of lower elongated testing cylinder 130 by means of threaded connection 143. Circumferential seals 141 are disposed around outer diameter of lower test seal assembly 140. In the preferred embodiment, lower test seal assembly has coarse left-hand male threads 142. Lower test seal assembly 140 is connected at its bottom to work string 180 by means of threaded connection 144.

As depicted in FIG. 3, in the preferred embodiment, test plug 150 is generally cylindrical in shape having inner bore 151, and outer profile 152. Outer profile 152 can be beveled to uniformly engage a wellhead during testing operations. In addition, circumferential seals 153 extend around the outer test plug 150. It should be recognized that outer profile 152 of test plug 150 must seat within and form a pressure-tight seal against the inner profile of a particular wellhead being used; accordingly, outer profile 152 of test plug 150 will typically depend on the particular brand or type wellhead being used.

In the preferred embodiment, inner bore 151 of test plug 150 is a polished receptacle with an inner diameter designed to receive seals 122 of upper test seal assembly 120, as well as seals 141 of lower test seal assembly 140. As depicted in FIG. 3, circumferential seals 141 of lower test seal assembly 140 engage polished bore 151 of test plug 150 to form a pressure-tight seal and prevent the passage of high pressure fluids between lower test seal assembly 140 and test plug 150.

Test plug 150 also includes coarse right hand female threads 154, and no-go landing 155 which forms a stopping point for no-go load shoulder 124 of upper test seal assembly 120, thereby preventing upper test seal assembly 120 from traveling below test plug 150. Coarse left-hand female threads 156 of test plug 150 receive coarse left-hand male threads 142, of lower test seal assembly 140. When so connected, coarse left-hand male threads 142 of lower test seal assembly 140 are engaged in coarse left-hand female threads 156 of test plug 150 to ensure that lower test seal assembly 140 remains stationary within inner bore 151 of test plug 150.

In the preferred embodiment, a length of drill pipe or other tubular work string 180 is first run into a well equipped with a subsea blowout preventer assembly to be tested. Test tool 100 is then connected to the top of said drill pipe or tubular work string by means of connection 144 at the base of lower test seal assembly 140, and lowered into said well via said drill pipe or tubular work string. Test tool 100 is lowered into said well sufficiently to allow test plug 150 to be landed or set within a wellhead situated immediately below a subsea blowout preventer assembly to be tested. Initially, testing tool 100 should be in the configuration depicted in FIG. 3, wherein lower seal assembly 140 is releasably connected to test plug 150 by means of coarse left-hand male threads 142 and coarse left-hand female threads 156. When configured as shown in FIG. 3, circumferential seals 153 of test plug 150 form a pressure-tight seal against the inner profile of said wellhead, while circumferential seals 141 of lower test seal assembly 140 form a pressure-tight seal against polished inner bore 151 of test plug 150.

With testing tool 100 in the configuration depicted in FIG. 3, and test plug 150 landed within a wellhead, lower elongated testing cylinder 130 will be positioned in direct alignment with individual blowout preventers to be tested. Each individual blowout preventer to be tested can be selectively closed to seal against the outer surface of lower elongated testing cylinder 130. Closing an individual blowout preventer against lower elongated testing cylinder 130 creates an enclosed zone extending between said closed blowout preventer and test plug 150. Said enclosed zone is then pressurized with high-pressure testing fluid via blowout preventer assembly choke line or kill line. In the event that test plug 150 should leak, then testing fluid will pass around test plug 150 and enter work string 180, and flow through inner bore 101 extending through test tool 100, thereby indicating to an operator at the surface that test plug 150 has not sealed properly within said wellhead. Conversely, if a blowout preventer being tested should leak, then testing fluid will pass between said blowout preventer and the outer surface of said lower elongated testing cylinder 130, thereby allowing fluid to flow through riser 40, indicating to an operator at the surface that a satisfactory test has not been obtained, and that said blowout preventer is not adequately holding pressure. Once a satisfactory test is obtained, then any other blowout preventer component of the blowout preventer assembly capable of sealing against the outer surface of lower elongated testing cylinder 130 can be tested in the same manner as described above.

Figure 3A:
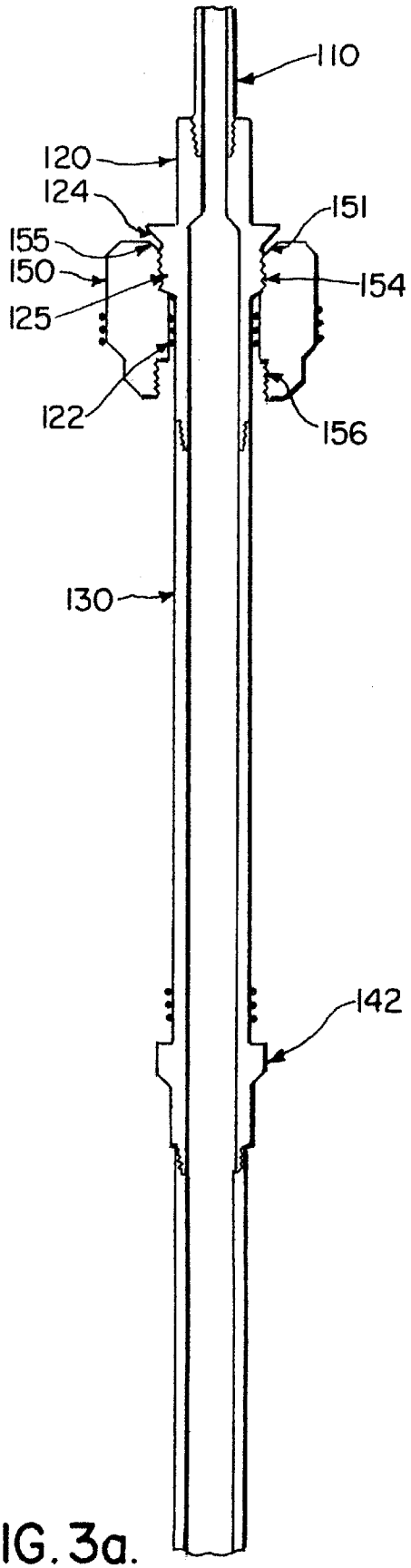

Referring to FIG. 3*a,* after all components of a blowout preventer system which are designed to seal against pipe having the same outer diameter dimension as lower elongated testing cylinder 130 are tested, the drill string can then be rotated in a clockwise direction to disconnect coarse left-hand male threads 142 from coarse left-hand female threads 156 of test plug 150. Test tool 100 is then lowered, with the exception of test plug 150 which remains stationary within a wellhead, allowing lower elongated testing cylinder 130 to slidably pass through inner bore 151 of test plug 150. Test tool 100 is lowered in this manner until upper test seal assembly 120 is received within inner bore 151 of test plug 150, and no-go load shoulder 124 lands on no-go landing 155 of test plug 150. Upper test seal assembly can be locked in this position by rotating coarse right-hand male threads 123 into coarse right hand female threads 154 of test plug 150. In this configuration, circumferential seals 122 of upper test seal assembly 120 engage polished inner bore 151 of test plug 150, thereby creating a pressure-tight seal between upper test seal assembly 120 and test plug 150.

Thereafter, each individual blowout preventer which is designed to seal against pipe having the same outer diameter dimension as upper elongated testing cylinder 110 can be tested by separately closing each blowout preventer and repeating the testing process described above. Specifically, by closing an individual blowout preventer against upper elongated testing cylinder 110, an enclosed zone is created which extends between said closed blowout preventer and test plug 150. Said enclosed zone is then pressurized with high-pressure testing fluid via blowout preventer assembly choke line or kill line. In the event that test plug 150 should leak, then testing fluid will pass around test plug 150 and enter work string 180, and flow through inner bore 101 extending through test tool 100, thereby indicating to an operator at the surface that test plug 150 has not sealed properly within said wellhead. Conversely, if a blowout preventer being tested should leak, then testing fluid will pass between said blowout preventer and the outer surface of said upper elongated testing cylinder 110, thereby allowing fluid to flow through riser 40, indicating to an operator at the surface that a satisfactory test has not been obtained, and that said blowout preventer is not adequately holding pressure.

After testing against upper elongated testing cylinder 110 is completed, test tool 100 can be completely retrieved by pulling said test tool out of the well.

Test tool 100 allows the safe and efficient testing of multiple blowout preventers which are configured to seal around various size pipe diameters in a single pipe trip. During the drilling of a subsea well, this feature is economically advantageous in that it saves rig time which would otherwise be necessary to trip one testing apparatus out of the well and replace it with another testing apparatus suitable for testing a different size blowout preventer.

Figure 4:
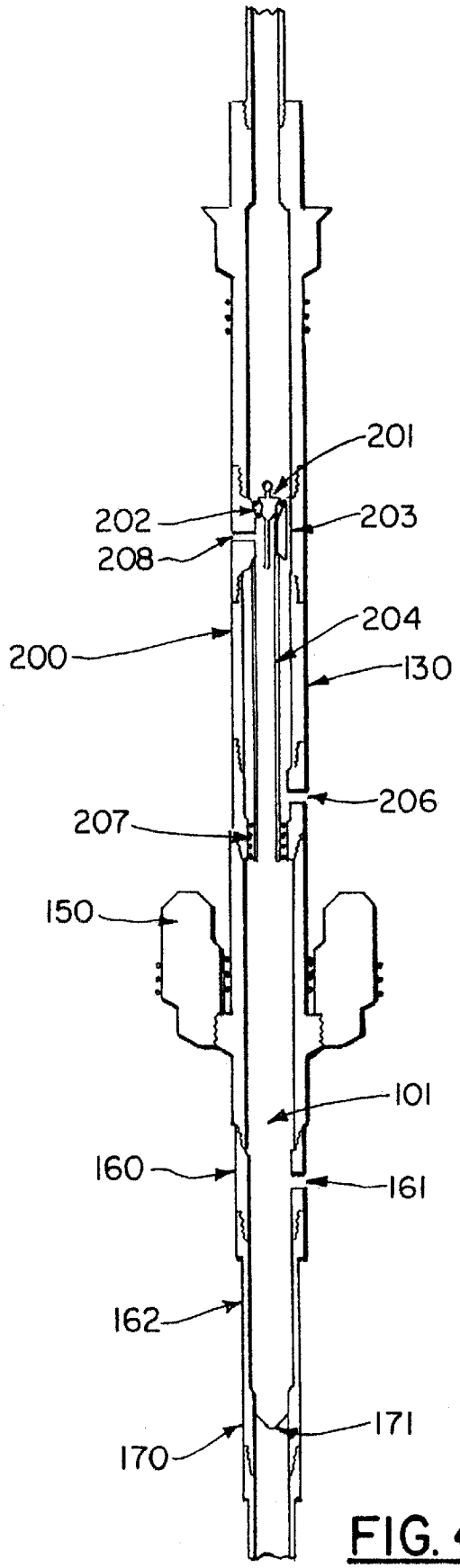
FIG. 4 is a schematic elevation view of an alternate embodiment of the testing apparatus of the present invention.

FIG. 4 depicts an alternative embodiment of the present invention including a circulating flow assembly 200, side port assembly 160 and check valve assembly 170. Side-port assembly 160 has a plurality of side ports 161 which are radially disposed through side-port assembly 160, such that inner bore 101 of side port assembly 160 is connected to the outer surface of said side port assembly 160. Side ports 161 allow fluid to flow in and out of inner bore 101 of side-port assembly 160 during testing operations.

Check-valve assembly 170 has inner bore 101 and check valve 171 disposed within check-valve assembly 170 so that drilling fluids are prevented from flowing upward through inner bore 101 of check-valve assembly 170, but are permitted to flow in a downward direction through inner bore 101. Check valve 171 can be any of several types of high-pressure, corrosion resistant check valves typically used in drilling operations. In the preferred embodiment, at least two joints of drill pipe or other tubular work string 162 are placed between side port assembly 160 and check valve assembly 170.

In the alternative embodiment depicted in FIG. 4, the test tool of the present invention is run into a well on a tubular work string, until test plug 150 is seated within a subsea wellhead. Prior to test plug 150 being seated, if so desired, fluid can be pumped from the surface through inner bore 101 of test tool 100 and outside port assembly 160 to clean or flush the inner surface of said wellhead.

Thereafter, dart 201 is placed into said work string at the drilling rig, and allowed to fall or be pumped to test tool 100. Dart 201 seats within shoulder profile 202, thereby forming a pressure-tight seal. Each individual blowout preventer to be tested can then be selectively closed to seal against lower elongated testing cylinder 130. Closing an individual blowout preventer against lower elongated testing cylinder 130 creates an enclosed zone extending between said closed blowout preventer and the test plug 150. Fluid is pumped from the drilling rig via said work string, and passes through cross-over channel 203 and into an annulus formed between inner cross-over tube 204 and the inner surface of lower elongated testing cylinder 130. Fluid is then directed outside said test tool into said enclosed zone via lower cross-over side ports 206.

In the event that a blowout preventer being tested should leak, testing fluid will pass between said blowout preventer and said lower elongated testing cylinder, thereby allowing pressure to be transmitted up riser 40, indicating to an operator at the surface that a satisfactory test has not been obtained, and that said blowout prevent is not adequately holding pressure. In the event that test plug 150 leaks, fluid will pass around said test plug 150 and into side port assembly 160. Fluid entering side port assembly 160 via side ports 161 is directed into inner cross over tube 204, and is prevented from reentering the annulus between inner cross over tube 204 and lower elongated testing cylinder 130 by inner seal assembly 207; however, fluid well flow out upper cross over side ports 208 and into the annulus between the work string and riser. Pressure will be transmitted up the annulus, thereby alerting an operator at the surface of a problem.

Use of alternative embodiment depicted in FIG. 4 is significant, in that it allows a subsea blowout preventer assembly to be tested without the need to pump pressurized fluid through a blowout preventer assembly's choke line or kill line. As such, valves situated on said choke line or kill line can also be tested from the direction of the well bore, rather than from the surface, which results in more desirable testing conditions.

In the event that a kick is experienced during blowout preventer testing operations, test tool 100 allows the operator to quickly, efficiently and safely shut-in a well without having to trip test tool 100 completely out of a well. Test tool 100 can be raised to a point where side port assembly is positioned above a blowout preventer assembly being tested, while check valve 171 in check-valve assembly 170 is located below said blowout preventer assembly being tested. The appropriate blowout preventer is then closed against the outer surface of drill pipe 162 in order to seal off the well annulus. Check valve 171 will prevent high pressure fluids from flowing up the drill pipe string. The operator can then unscrew or otherwise disconnect test tool 100 above said check valve assembly, and remove the remainder of said test tool from the well with the well safely shut in. The operator can then screw back into the apparatus with a standard drill string, and commence well control operations as necessary. Significantly, in this configuration the operator can pump down the drill pipe, if desired, as part of said well control operations.

It should be noted that the description of the preferred embodiment of test tool 100, including the alternative embodiment depicted in FIG. 4, contemplates external circumferential seals 122 of upper test seal assembly 120 and external circumferential seals 141 of lower test seal assembly 140, both of which can engage against polished inner bore 151 of test plug 150 to form a pressure-tight seal. However, it is envisioned that, alternatively, bore 151 of test plug 150 can be equipped with internal seals, while upper test seal assembly 120 and lower test seal assembly 140 can be equipped with polished external surfaces which can be received within said internal seals of bore 151.

What is claimed is:

1. An apparatus for testing a blowout preventer system comprising:

a) a lower test cylinder having a longitudinal bore therethrough;

b) a tube, having a longitudinal bore therethrough, concentrically disposed within said longitudinal bore of said lower test cylinder, defining an annular void between the outer surface of said tube and the inner surface of said lower test cylinder;

c) a pressure seal between the outer surface of said tube and the inner surface of said lower test cylinder;

d) at least one communication port extending from the longitudinal bore of said lower test cylinder to said annular space between the outer surface of said tube and the inner surface of said lower test cylinder;

e) at least one communication port extending from the outer surface of said lower test cylinder to the longitudinal bore of said tube;

f) a first seal assembly having a longitudinal bore therethrough, connected to the bottom of said lower test cylinder, wherein the longitudinal bore of said first seal assembly is axially aligned with the longitudinal bore of said lower test cylinder;

g) a tubular drill pipe having a longitudinal bore therethrough and connected to the bottom of said first seal assembly, wherein said longitudinal bore of said tubular drill pipe is axially aligned with the longitudinal bore of said lower test cylinder and said first seal assembly;

h) at least one communication port extending from the inner surface of said tubular drill pipe to the outer surface of said tubular drill pipe;

i) a second seal assembly having a longitudinal bore therethrough, connected to the top of said lower test cylinder, wherein the longitudinal bore of said second seal assembly is axially aligned with the longitudinal bore of said first seal assembly and said lower test cylinder;

j) a wellhead test plug having an inner bore, wherein said first seal assembly, said lower test cylinder, and said second seal assembly are slidably disposed within said inner bore of said wellhead test plug;

k) releasable locking means, operably associated with said wellhead test plug, said first seal assembly and said second seal assembly, for releasably locking said wellhead test plug in one of a first position wherein said wellhead test plug is immediately adjacent to said first seal assembly, and a second position, wherein said wellhead test plug is immediately adjacent to said second seal assembly;

l) a check valve attached to the bottom of said tubular drill pipe;

m) an upper test cylinder having a longitudinal bore therethrough and connected to the top of said second seal assembly, wherein said longitudinal bore is axially aligned with the longitudinal bore of said lower test cylinder and said first and second seal assemblies; and n) means for closing said longitudinal bore of said tube immediately above the at least one communication port extending from the outer surface of said lower test cylinder to the longitudinal bore of said tube.

2. The apparatus of claim 1 wherein the outer diameter of said upper test cylinder is different than the outer diameter of said lower test cylinder.

3. The apparatus of claim 2 wherein the outer diameter of said upper test cylinder is less than the outer diameter of said lower test cylinder.

4. The apparatus of claim 1 wherein said means for closing said longitudinal bore of said tube immediately above the uppermost communication port extending from the outer surface of said lower test cylinder to the longitudinal bore of said tube further comprises:

a) a bore near the upper end of said tube; and b) a dart which can seat within said bore and form a pressure seal.

* * * * *